US005363519A

United States Patent [19]

Husting

[11] Patent Number: 5,363,519

[45] Date of Patent: Nov. 15, 1994

[54] DRAIN VALVE ASSEMBLY

[75] Inventor: Thomas J. Husting, Port Washington, Wis.

[73] Assignee: Kohler Co., Kohler, Wis.

[21] Appl. No.: 996,302

[22] Filed: Dec. 23, 1992

[51] Int. Cl.[5] ..... E03C 1/23

[52] U.S. Cl. ..... 4/689; 251/65; 251/129.15

[58] Field of Search ..... 4/689–693; 251/65, 129.15

[56] References Cited

U.S. PATENT DOCUMENTS

| | | | |
|---|---|---|---|
| 1,501,303 | 7/1924 | Berry . | |
| 2,180,790 | 11/1939 | Brummett . | |
| 2,989,758 | 6/1961 | Turek et al. | 4/689 |
| 3,099,019 | 7/1963 | Tiller | 4/689 |
| 3,368,788 | 2/1968 | Padula . | |
| 3,652,054 | 3/1972 | Layton . | |
| 4,042,984 | 8/1977 | Butler . | |
| 4,338,968 | 7/1982 | Mercier | 251/65 X |
| 4,559,971 | 12/1985 | Bradshaw . | |
| 4,564,046 | 1/1986 | Lungu . | |
| 4,794,890 | 1/1989 | Richeson | 251/65 X |
| 4,890,815 | 1/1990 | Hascher-Reichl . | |
| 4,945,579 | 8/1990 | Husting . | |
| 5,029,807 | 7/1991 | Fuchs . | |
| 5,069,422 | 12/1991 | Kawamura | 251/65 X |

FOREIGN PATENT DOCUMENTS

| | | | |
|---|---|---|---|
| 0487215 | 5/1992 | European Pat. Off. | 4/691 |

*Primary Examiner*—Charles E. Phillips
*Attorney, Agent, or Firm*—Quarles & Brady

[57] ABSTRACT

Disclosed herein is a drain valve for a bathtub or other gravity drained container. When energized with an electrical pulse, a solenoid mounted directly below the drain elbow drives the poppet upward, which unseals the outlet drain. A permanent magnet latches the solenoid armature in place in the up position. The valve is closed by energizing the solenoid with a pulse of opposite polarity which pulls the armature downward and out of the influence of the permanent magnet. A piston in a sleeve over-nested by a movable shroud provides leakage protection and allows manual opening and closing.

15 Claims, 5 Drawing Sheets

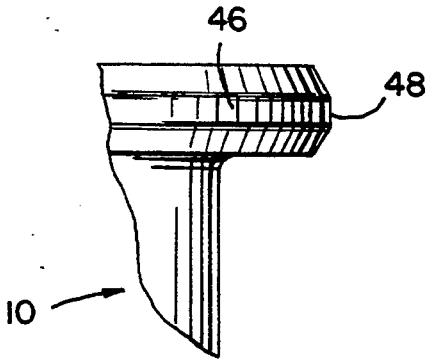
FIG. 9
FIG. 10
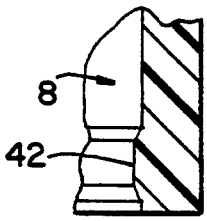
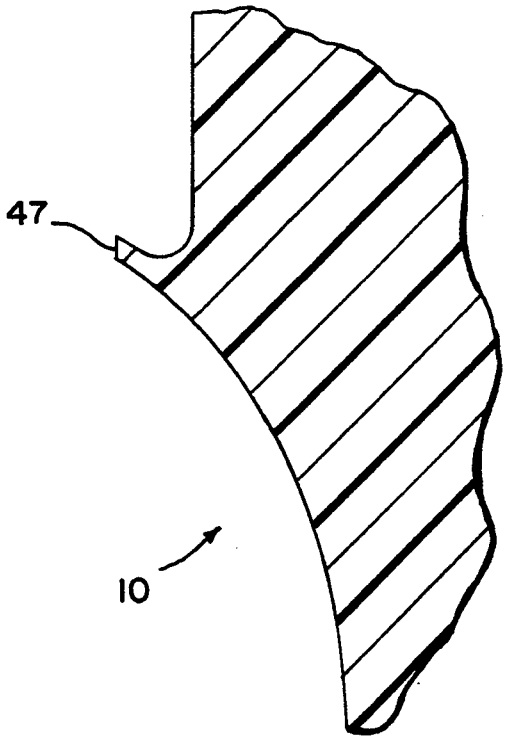
FIG. 11

DRAIN VALVE ASSEMBLY

FIELD OF THE INVENTION

This invention relates to drain valves for bathtubs and other fluid bearing containers. More particularly, it relates to drain valves that can be operated both manually and electrically.

DESCRIPTION OF THE ART

Prior electric drain valves, typically using a solenoid, have sought to magnetically move metal armatures located inside drain conduits. See U.S. Pat. Nos. 2,180,790 and 3,652,054. This is energy inefficient and sometimes hard to assemble. Other systems locate the connection to the solenoid upstream of the drain valve. See U.S. Pat. No. 4,042,984. This may require access to a position that is hard to reach, and in any event requires complex linkage. Other electric valves may suffer from one or more of the following deficiencies: (1) they cannot easily be operated manually; (2) they do not allow easy access for maintenance, or replacement; (3) they do not adequately seal from the water flow; (4) they are not easily retrofitted on existing bathtubs or sinks.

Thus, a need exists for an improved drain valve assembly.

SUMMARY OF THE INVENTION

The invention provides a drain valve assembly for causing a valve poppet to seal and unseal a drain opening facing inward toward the interior of a container of liquid. A drain conduit, which is connectable to the drain opening, has a portion shaped to move the liquid outflow transverse to a longitudinal axis of the drain opening. The drain conduit has an outer wall with a hole therethrough in the portion which transversely moves the outflow.

A drive member which extends through the hole is connectable to the poppet such that one direction of motion of the drive member will drive the poppet inward to unseal the poppet valve. A second direction of motion of the drive member permits the valve popper to seal the drain opening.

There are electrically powered means mounted outside of the drain conduit for moving the drive member.

In one aspect, the electrically powered means is a solenoid coil which moves an armature which, via a drive member, can directly push the poppet. When the solenoid coil is powered by a pulse of electricity of one polarity, it drives the armature to a magnetically latched position in which the poppet does not seal the drain opening. When an electrical pulse of the opposite polarity is applied to the solenoid coil, it pulls the armature out of the influence of the latch magnet and thereby allows the poppet to seal the drain opening.

In another aspect, the invention provides an apparatus which facilitates manual and electrical operation, prevents leaks and provides easy access for cleaning and adjustment. It includes a liquid deflecting shroud which can push the poppet and which telescopes over a sleeve circumscribing the drive member hole.

For manual operation, the shroud provides initial slack to facilitate manual grasping of the poppet. As the user continues to raise the poppet, an interior lip on the shroud engages a flange on a piston which moves within and seals against the interior of the sleeve and which is connected to the drive member. The shroud lip raises the piston flange which, via the drive men%her, raises the armature eventually to the point where it is latched by the magnet.

In electrical operation, the drive member pushes the piston against the shroud, which moves the poppet.

The apparatus facilitates easy access and cleaning because the shroud lip can snap past the piston flange if the user continues to manually raise the poppet. The user can thereby easily remove the poppet and the shroud out of the drain opening allowing unrestricted access to the drain conduit.

The drain conduit is designed to be installed on the drain openings of existing containers, facilitating retrofitting. The shroud is adjustable to further provide flexibility in fitting into existing installations.

Accordingly, the objects of the invention include providing a directly activated electric drain valve that:

a) may be opened or closed manually as well as electrically;
b) is simple and durable;
c) is inexpensive and easy to produce, install and repair;
d) is easy to clean and adjust;
e) is versatile enough to be retrofitted into conventional systems; and
f) uses a small inexpensive solenoid and a minimal amount of electrical energy to operate.

These and still other objects and advantages of the present invention will be apparent from the description which follows. In the description, reference will be made to the accompanying drawings which form a part hereof. The drawings show, by way of illustration, preferred embodiments of the invention. Such embodiments do not represent the full scope of the invention. Reference should therefore be made to the claims herein for interpreting the scope of the invention.

DESCRIPTION OF THE DRAWINGS

FIG. 9 is an enlarged side view of the tapered edge of the piston flange;

FIG. 10 is an enlarged cross-sectional view of the shroud lower lip; and

FIG. 11 is an enlarged view of a piston lip.

DESCRIPTION OF THE PREFERRED EMBODIMENT

The drawings show the invention embodied as a drain valve assembly (generally 2) installed in a bathtub 1 having a drain outlet 3 leading to drain line or conduit 4.

Figure 2:
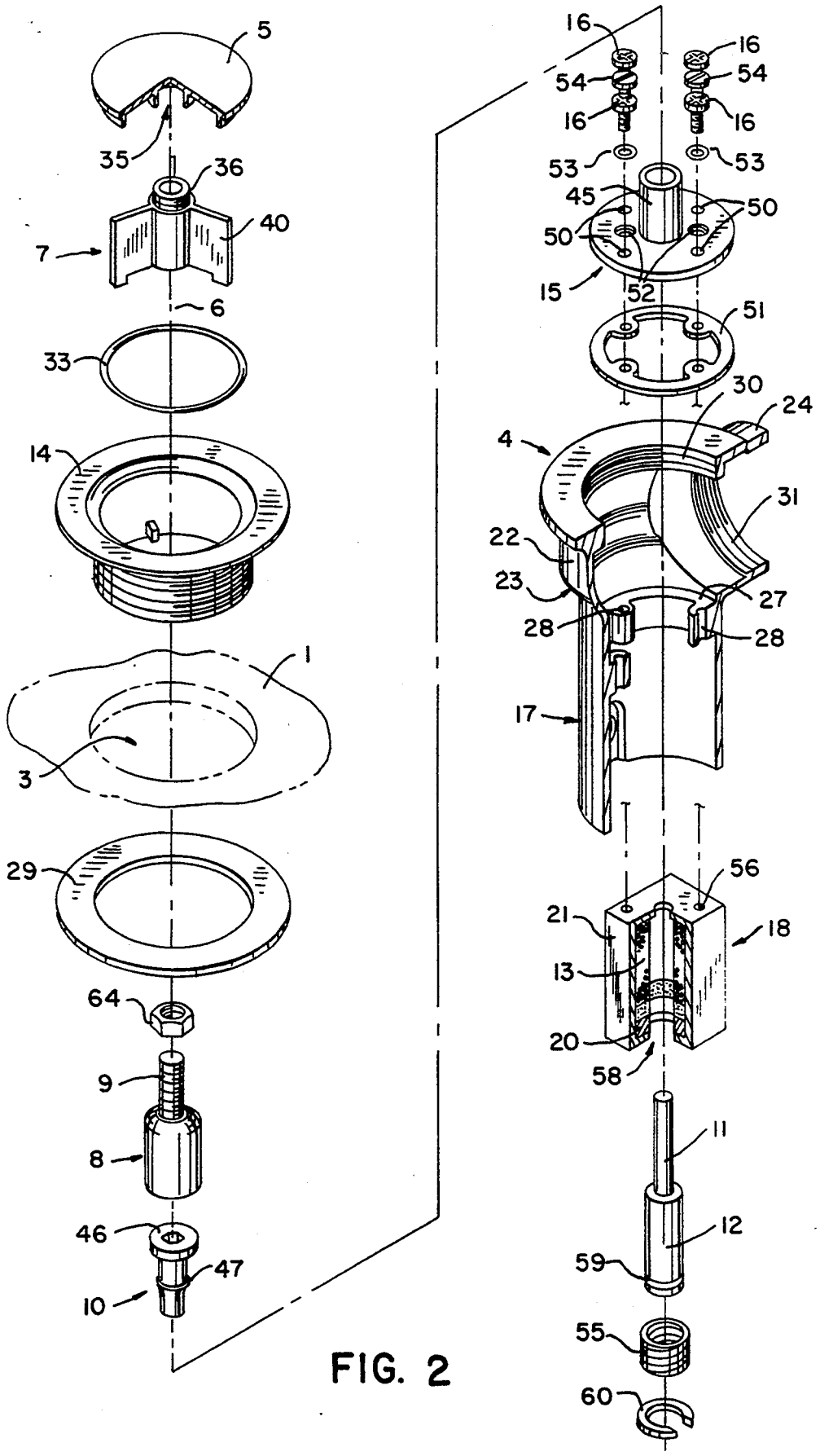
FIG. 2 is an exploded perspective view of the components of the valve.

FIG. 2 best shows the train of movable parts which move along a central longitudinal axis 6. These moving parts include a poppet 5, a poppet guide 7 threaded to the poppet 5, a shroud 8 having a neck 9 which is threadably fastened to popper guide 7, a piston 10, and a drive member 11 which fits into the piston 10 at one end and into a ferromagnetic tubular armature core 12 at the other. Except for the armature 12, all moving parts are made of plastic, nylon, or a non-corrosive light weight metal to minimize the size of the solenoid coil 13 necessary to operate the assembly 2.

These movable parts translate within a structure of otherwise stationary parts. The stationary parts include the drain line 4 which is threadably fastened to the poppet seat 14, a mounting plate 15 secured to the interior of the drain line 4 by four non-corrosive metallic mounting screws 16, a tubular solenoid housing 17 attached (as by welding) to or formed on the underside of the drain line 4, a solenoid assembly 18, including a solenoid coil 13 and a permanent ring magnet 20, secured to the bottom surface of the mounting plate 15 and encased by a solenoid casing 21.

As noted above, a major stationary part is the drain line 4, which serves double duty as a conduit and as a housing for part of the valve mechanism. Drain line 4 is an elbow with an upright section 22 extending to the drain outlet 3, and a horizontal section 24. The bottom of horizontal section 24 has a hole over which mounting plate 15 is attached and under which solenoid housing 17 is positioned. Housing 17 is an open-bottomed elongated hollow cylinder having at its top an internal annular shelf 27 on which are formed four longitudinally bored mounting posts 28 equispaced circumferential on the interior surface of the shelf 27. Together shelf 27 and posts 28 define a flat surface onto which the mounting plate 15 is fastened. Referring particularly to FIG. 2, the drain line inlet 30 is designed to be screwed onto conventional popper seats 14, and the drain line outlet 31 is designed to threadably receive a conventional drainage pipe 32.

Popper 5, which along with its rubber O-ring 33 and the poppet seat 14 can seal drain outlet 3, has a threaded circular bore 35 which receives connecting member 36 of poppet guide 7, which also has an internal threaded bore 38 and three arms 40 extending radially outward. Poppet guide 7 slidably moves within the opening of popper seat 14 and thereby guides the movement of the movable parts along longitudinal axis 6.

Figure 7:
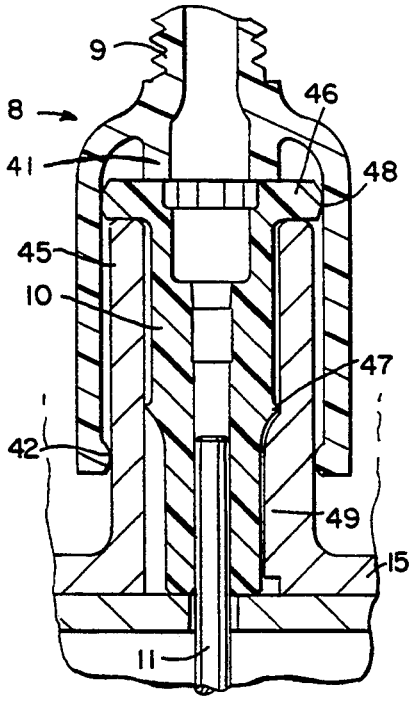
FIG. 7 is an enlarged cross-sectional view of the shroud and piston insert portion of the drain valve in the closed position as in FIG. 3.

Internal bore 38 of poppet guide 7 receives neck 9 of shroud 8, which is hollow and open-bottomed, is generally bottle shaped and is made of a hard, rigid material. As best seen in FIG. 7, near the top of the hollow interior of shroud 8 is an annular, downwardly projecting abutment 41 which, as will be seen below, provides a surface against which piston 10 can push to open the drain. Along the bottom edge of the shroud 8 there is an inwardly extending circumferential lip 42, shown particularly in FIG. 10. The shroud 8 slidably fits over the outside of hollow cylindrical sleeve 45 which projects upward from mounting plate 15.

Within the hollow interior of sleeve 45 there slidably moves the cylindrical piston 10 which is capped by a flange 46. Flange 46 extends radially outward beyond sleeve 45 and culminates in a tapered edge 48 (see FIG. 9) which cooperates with lip 42 of shroud 8. Lower down on piston 10 is annular lip 47, which is angled upward (see FIG. 11) and wipes and seals the interior surface of sleeve 45. Piston 10 is made of a polyester elastomer material, such as Dupont Hytrel, which is semi-rigid in thick cross-section and is flexible in thin cross-section. As a result, tapered edge 48 and lip 47 are resilient. The top of flange 46 has an indentation shaped to accommodate a hex wrench.

As noted above, the sleeve 45, over which shroud 8 rides and within which piston 10 moves, protrudes upward from mounting plate 15. The lower portion of the inner surface of sleeve 45 has three longitudinally elongated inwardly protruding guide ribs 49 which have curved tops and which serve to guide the portion of piston 10 which is below lip 47. The ribs therefore help maintain the train of moving parts along the longitudinal axis 6.

A gasket 51, made of rubber or another sealing material, is mounted between mounting plate 15 and shelf 27. Mounting plate 15 has two other holes 52 which are countersunk to accommodate sealing O-rings 53 and screws 54 which are used to mount solenoid assembly 18 to the underside of mounting plate 15.

The solenoid assembly 18 consists of a solenoid coil 13 and a permanent ring magnet 20 mounted in the solenoid casing 21, which has holes 56 to accommodate screws 54 (see FIG. 2). The solenoid coil 13 is chosen to have sufficient power to open and close the valve assembly 2 (i.e. to lift the weight of the moving parts and the potential water column above the poppet and to overcome friction and the force of spring 55). The solenoid coil 13 is powered and controlled by a conventional electrical source and circuit (not shown).

The permanent ring magnet 20 is fastened directly under the solenoid coil 13 and coaxially therewith. It is chosen to be able to provide sufficient force to manually hold the valve assembly 2 in the open position (e.g. enough to resist spring 55 and assembly and water column weight as well as the hydrodynamic forces resulting from the flow of water around the poppet). The solenoid coil 13 and permanent magnet 20 together define a tubular magnetic passageway 58 under the drain line 4 (preferably coaxial with the axis 6). Solenoid casing 21 is made of non-ferrous material.

A ferromagnetic tubular armature 12, preferably made of soft iron, is disposed to slidably move along longitudinal axis 6 within the magnetic passageway 58. The lower end of the armature 12, which extends below solenoid casing 21, has an annular groove 59 that receives a snap ring 60. Between the snap ring 60 and the bottom of the solenoid casing 21, armature 12 is encompassed by spring 55 which lightly urges armature 12 downward and serves to cushion and dampen upward movement of the armature 12. The tubular drive member 11 which extends longitudinally upward from the armature 12 partially through the sleeve 5 is attached to the bottom of the piston 10.

After assembly, the train of movable parts is connected downward as follows. In the closed position shown in FIG. 3, poppet 5 rests in popper seat 14, thereby sealing drain opening 3. From poppet 5 is suspended poppet guide 7, from which shroud 8 is suspended by its neck 9. The next movable part down, piston 10, is not suspended from shroud 8—i.e., manually lifting poppet 5 raises shroud 8 but does not initially raise piston 10. Rather than being suspended from shroud 8, the lower movable parts are suspended from piston 10, which is supported by its flange 46 which rests on the top of sleeve 45. More particularly, drive member 11 is suspended from piston 10 and armature 12 is suspended from drive member 11.

Figure 1:
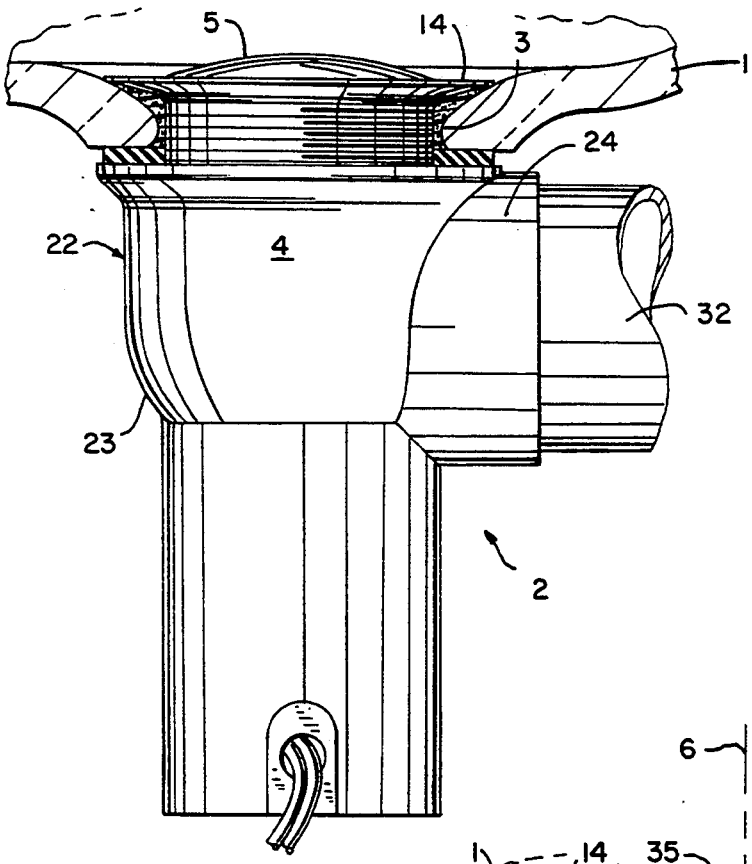
FIG. 1 is a side elevational view of a preferred drain assembly embodying the present invention installed (partially in section)
Figure 3:
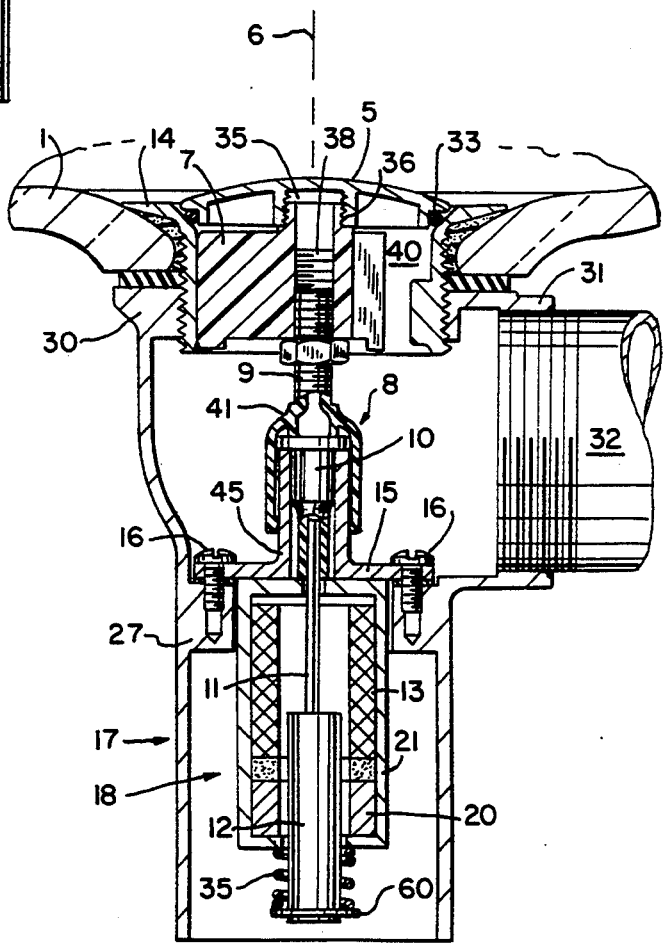
FIG. 3 is a side cross-sectional view of the drain valve (shown in the closed position)
Figure 4:
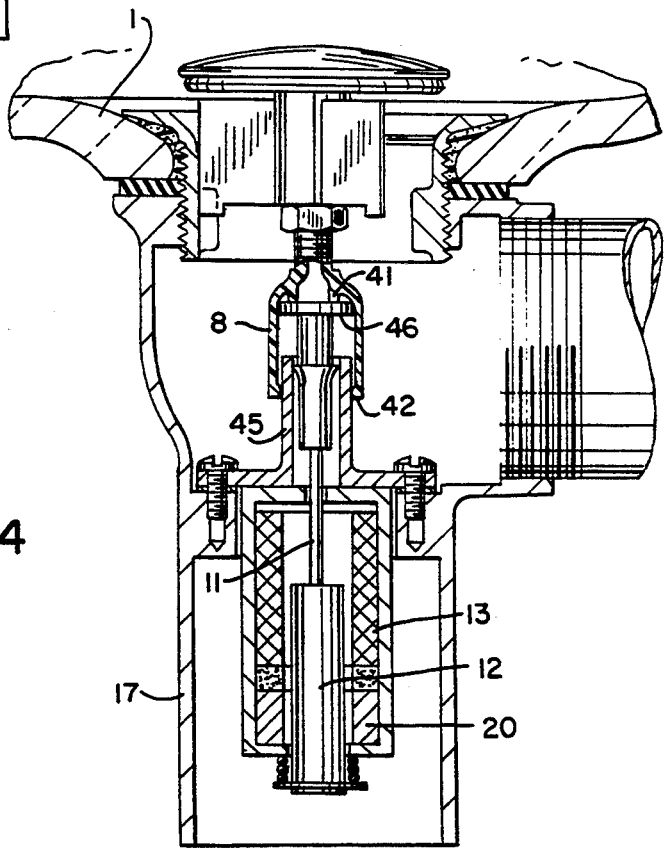
FIG. 4 is a view similar to FIG. 3, but in the open position.

Beginning in the closed position of FIG. 3, the drain is opened by applying to the solenoid coil 13 a short electrical signal (on order of 100 ms) having the polarity which creates an electromagnetic field in the magnetic passageway 58 which moves the armature 12 upward to the position shown in FIG. 4. Armature 12 is held in that position by permanent magnet 20 regardless of whether current continues. The upward movement of armature 21 is translated via drive member 11, piston 10, piston flange 46, shroud abutment 41, shroud 8 and guide 7 to the poppet 5 and thereby moves the poppet 5 upward into the open position as shown in FIG. 4.

To close the device, an electrical signal of the opposite polarity is applied to the solenoid coil 13 at a magnitude sufficient to overcome the permanent magnet for a duration of less than 1 second. Solenoid coil 13 pulls armature 12 out of the influence of the permanent magnet. This lowers piston 10 which permits shroud 8 and its following parts to descend with gravity. As shown in FIG. 3, piston 10 is at this point in position to seal sleeve 48.

Figure 5:
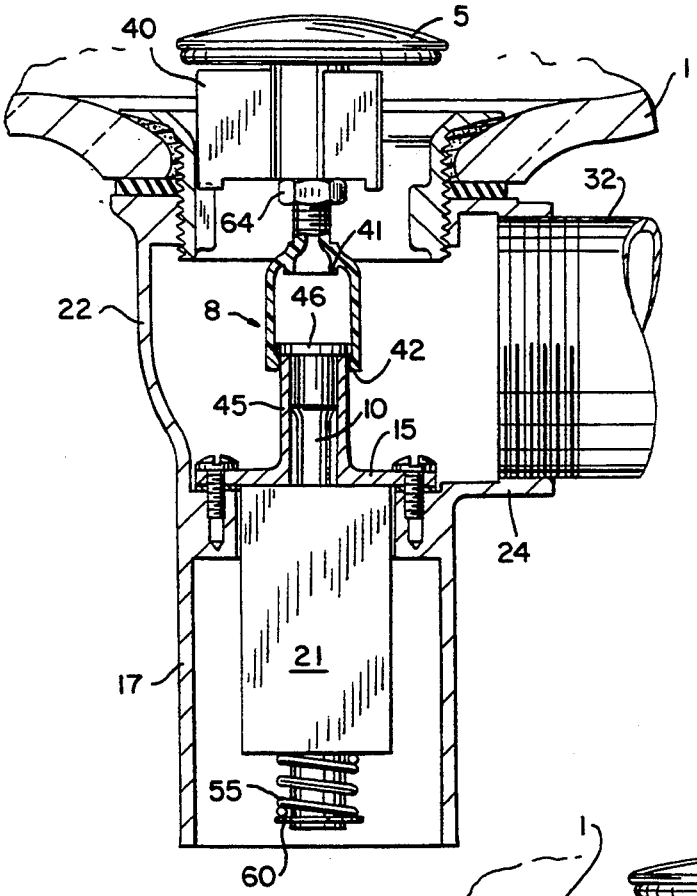
FIG. 5 is a side partially cross-sectional view showing a drain valve in a manually-held open position.
Figure 8:
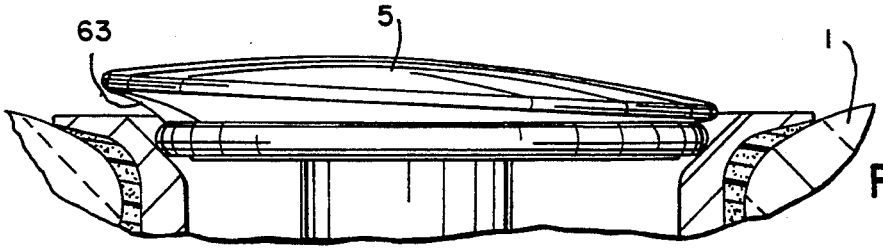
FIG. 8 is a side elevational view of a poppet.

A user can also manually open the drain by lifting poppet 5. Grasping and lifting poppet 5 is facilitated by the fact that shroud 8 is not directly connected to piston 10 (i.e. shroud 8 is free to move upward along sleeve 45). In this regard, poppet 5 may be provided with a finger ledge 63, as shown in FIG. 8 to facilitate manual grasping. Of course, continued manual lifting eventually causes lip 42 of shroud 8 to encounter piston flange 46, as shown in FIG. 5. In this position shroud lip 42 raises piston flange 46 and thereby raises armature 12 until it reaches the position in which it is latched by permanent magnet 20. When the user releases the poppet, it drops slightly and is then held in the same open position of FIG. 4 as was attained by the electrical lifting described earlier.

To manually close the valve assembly 2, the user simply pushes down on poppet 5 (which lowers armature 12 out of the influence of permanent magnet 20).

Figure 6:
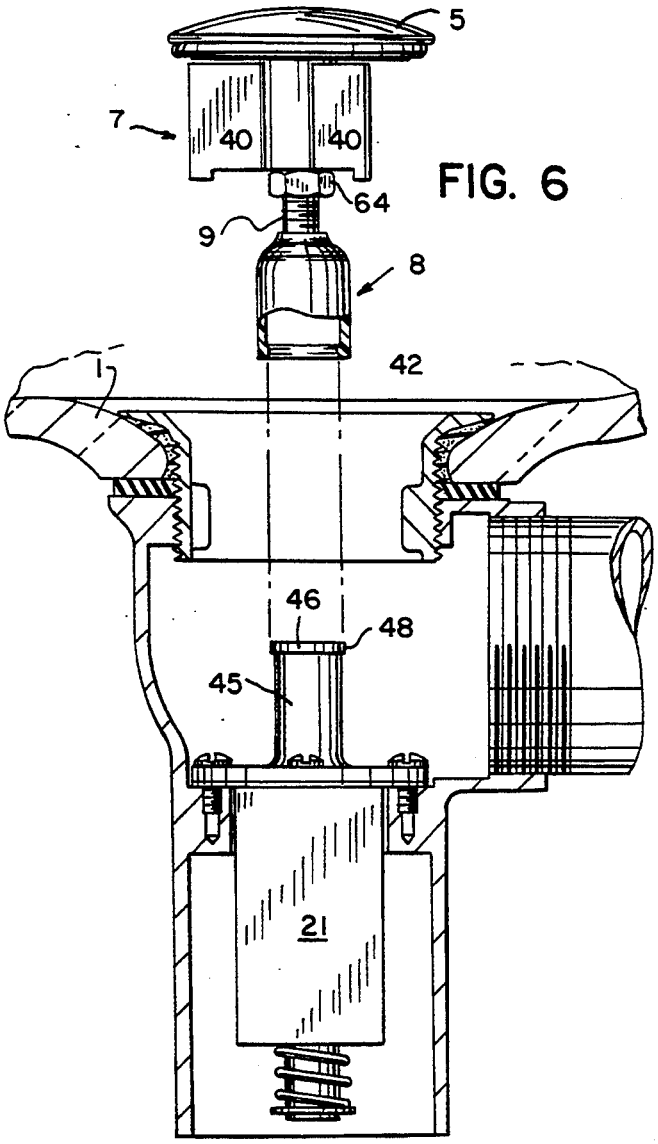
FIG. 6 is a side partially cross-sectional view in which poppet and shroud have been removed.

If, upon use, it is found that adjustments are needed or that debris is caught in the drain line 4, the user can easily remove the poppet 5, guide 7 and shroud 8 by lifting poppet 5 even beyond the point at which permanent magnet 20 holds the drain in the open position as described above. Further pulling causes edge 48 of piston flange 46 to deform and allow shroud lip 42 to snap past it. Once that occurs the popper 5, guide 7 and shroud 8 can be lifted out of the drain outlet 3 to be cleaned or adjusted, as shown in FIG. 6.

The drain valve assembly can easily be adjusted for retrofitting into existing installations of varying dimensions. This is done by screwing neck 9 of shroud 8 more or less into internal bore 38 of poppet guide 7. Once adjusted, the setting is maintained by locknut 64.

While a particular embodiment of the invention has been shown, the invention claimed is not limited thereto since modifications within the scope of the invention may be made by those skilled in the art, particularly in light of the foregoing teachings. For example, the electrically powered means could be an electric motor whose rotation is converted to longitudinal motion of the drive member by gearing, threaded coupling or other means. Thus the invention is not to be limited by the specific description above, but is defined by the claims which follow.

I claim:

1. A drain valve assembly for causing a valve poppet to seal and unseal a downward facing drain opening of a container of liquid, comprising:

a drain conduit connectable to the drain opening and having a portion shaped to move liquid outflow at least partially transverse to a longitudinal axis of the drain opening, the said at least partially transverse portion having a lower wall on which the draining liquid flows, the lower wall having a hole therethrough;

a drive member extending upward through the hole and connectable to the poppet such that one direction of motion of the drive member will drive the poppet upward to unseal the valve poppet, and a second direction of motion of the drive member will permit the valve poppet to seal the drain opening;

electrically powered means mounted outside the conduit below said lower wall for moving the drive member; and means for preventing liquid from leaking out of the conduit through the hole and onto the electrically powered means, the leak preventing means including a sleeve which circumscribes the hole and a piston which is formed on the drive member, is positioned at least partially within the sleeve and has a peripheral surface which seals against the sleeve.

2. The assembly of claim 1, wherein the electrically powered means is mounted in alignment with said longitudinal axis.

3. The assembly as recited in claim 1, in which the electrically powered means comprises a solenoid coil having an armature linked to the drive member, wherein when the solenoid coil is powered with electricity having a first polarity it moves the armature to a first position in which the drive member causes the valve poppet to unseal the drain opening.

4. The assembly as recited in claim 3, further comprising magnetic holding means for maintaining the armature in the first position if electrical power is disconnected from the solenoid while the armature is in that first position.

5. The assembly of claim 4, wherein if the solenoid coil is powered by electricity of a polarity opposite to the first polarity, the solenoid coil allows the poppet to move to a sealed position.

6. A drain valve assembly as recited in claim 5, in which the magnetic holding means is a permanent magnet.

7. A drain valve assembly as recited in claim 1, in which the means for preventing liquid from leaking out of the conduit through the hole further comprises:

a shroud moveably telescoping around and inwardly of the sleeve and thereby directing liquid away from the sleeve.

8. A drain valve assembly as recited in claim 7, in which:

the piston has a flange extending across and laterally beyond the inward end of the sleeve, and culminating in a peripheral edge;

the shroud has a lip extending towards the sleeve; and wherein the peripheral edge of the flange and the lip of the shroud are disposed to inhibit the edge and the lip from passing each other.

9. A drain valve assembly as recited in claim 8, in which the peripheral edge of the flange and the lip of the shroud will resiliently pass each other upon application of a preselected level of force between the shroud and the piston.

10. A drain valve assembly as recited in claim 7, further comprising threaded means for adjusting the distance between the shroud and the valve poppet.

11. An electrically operated valve for opening and closing the drain outlet of a gravity drained container of liquid, comprising:

a) a conduit connectable so as to be in communication with the drain opening and shaped to direct the liquid flow to a non-vertical direction, the conduit having a lower wall with a hole that is vertically alignable with the drain opening;

b) a solenoid housing formed on the underside of the lower wall of the conduit circumscribing the hole and having an internal annular shelf near its upper end;

c) a mounting plate secured to the internal annular shelf of the solenoid housing;

d) a sleeve extending longitudinally upward into the conduit from the mounting plate and having an upper edge and an internal cylindrical surface;

e) a solenoid assembly with a magnetic passageway therethrough fastened to the underside of the mounting plate inside the solenoid housing, the solenoid assembly having:

(1) a solenoid coil;

(2) a permanent ring magnet; and (3) a solenoid casing holding the solenoid coil and the permanent magnet;

f) a drive assembly disposed to move up and down at least partially within the magnetic passageway, having:

(1) an armature core; and (2) a drive member formed at the top of the armature and which extends up out of the solenoid assembly and into the mounting sleeve;

g) a helical spring around the lower end of the armature for dampening the upward movement of the armature;

h) a piston that slidably moves inside the sleeve, the piston having a longitudinal bore in which the drive member is fastened;

i) a non-porous, open-ended shroud having:

(1) a upwardly extending externally threaded neck; and (2) a hollow capable of moveably resting over and around the sleeve, and capable of having an internal surface suitable for resting on the piston; and j) a poppet valve capable of being pushed upward by the shroud.

12. A drain valve assembly for causing a valve poppet to seal and unseal an inward facing drain opening of a container of liquid, comprising:

a drain conduit connectable to the drain opening and having a portion shaped to move liquid outflow at least partially transverse to a longitudinal axis of the drain opening, the conduit having an outer wall with a hole therethrough in said portion;

a drive member extending through the hole and connectable to the poppet such that one direction of motion of the drive member will drive the poppet inward to unseal the valve poppet, and a second direction of motion of the drive member will permit the valve poppet to seal the drain opening;

electrically powered means mounted outside the conduit for moving the drive member; and means for preventing liquid from leaking out of the conduit through the hole comprising a sleeve circumscribing the hole, a piston formed on the drive member and positioned at least partially within the sleeve and having a peripheral surface which seals against the sleeve, and a shroud movably telescoping around and inwardly of the sleeve and thereby directing liquid away from the sleeve.

13. A drain valve assembly as recited in claim 12, in which:

the piston has a flange extending across and laterally beyond the inward end of the sleeve, and culminating in a peripheral edge;

the shroud has a lip extending towards the sleeve; and wherein the peripheral edge of the flange and the lip of the shroud are disposed to inhibit the edge and the lip from passing each other.

14. A drain valve assembly as recited in claim 13, in which the peripheral edge of the flange and the lip of the shroud will resiliently pass each other upon application of a preselected level of force between the shroud and the piston.

15. A drain valve assembly as recited in claim 12, further comprising threaded means for adjusting the distance between the shroud and the valve poppet.

* * * * *